US010803740B2

(12) United States Patent
Malkes et al.

(10) Patent No.: US 10,803,740 B2
(45) Date of Patent: Oct. 13, 2020

(54) SYSTEM AND METHOD OF NAVIGATING VEHICLES

(71) Applicant: Cubic Corporation, San Diego, CA (US)

(72) Inventors: William A. Malkes, Knoxville, TN (US); William S. Overstreet, Knoxville, TN (US); Jeffery R. Price, Knoxville, TN (US); Michael J. Tourville, Lenoir City, TN (US)

(73) Assignee: Cubic Corporation, San Diego, CA (US)

( * ) Notice: Subject to any disclaimer, the term of this patent is extended or adjusted under 35 U.S.C. 154(b) by 0 days.

(21) Appl. No.: 16/059,814

(22) Filed: Aug. 9, 2018

(65) Prior Publication Data

US 2019/0051162 A1 Feb. 14, 2019

Related U.S. Application Data

(60) Provisional application No. 62/544,551, filed on Aug. 11, 2017, provisional application No. 62/545,283, filed on Aug. 14, 2017.

(51) Int. Cl.
*G06G 7/70* (2006.01)
*G06G 7/76* (2006.01)
(Continued)

(52) U.S. Cl.
CPC ..... *G08G 1/0145* (2013.01); *G08G 1/0116* (2013.01); *G08G 1/0129* (2013.01);
(Continued)

(58) Field of Classification Search
CPC .. G08G 1/0145; G08G 1/0116; G08G 1/0129; G08G 1/0133; G08G 1/0967; G08G 1/01; G08G 1/00
(Continued)

(56) References Cited

U.S. PATENT DOCUMENTS 4,833,469 A 5/1989 David
5,111,401 A 5/1992 Everett et al.
(Continued)

FOREIGN PATENT DOCUMENTS

CN 100533151 8/2009
CN 101799987 8/2010
(Continued)

OTHER PUBLICATIONS

Dehghan et al., Afshin; "Automatic Detection and Tracking of Pedestrians in Videos with Various Crowd Densities", Pedestrian and Evacuation Dynamics 2012.
(Continued)

*Primary Examiner* — Mahmoud S Ismail
(74) *Attorney, Agent, or Firm* — Kilpatrick Townsend & Stockton, LLP

(57) ABSTRACT

A traffic control system and a method are provided for detecting changes in traffic patterns at an intersection, establishing traffic rules therefore, and communicating the same to objects at the intersection. The method comprises receiving, by a processor, traffic data at an intersection; determining, by the processor, an average path taken by one or more objects at the intersection; determining, by the processor, a deviation of the average path from a historical average path; based on the deviation, determining by the processor, a traffic rule is to be implemented for incoming objects detected; and communicating, by the processor, the traffic rule to the incoming objects.

20 Claims, 6 Drawing Sheets

(51) Int. Cl.

| | |
|---|---|
| ***G08G 1/00*** | (2006.01) |
| ***G08G 1/01*** | (2006.01) |
| ***G08G 1/0967*** | (2006.01) |
| ***G08G 1/081*** | (2006.01) |
| ***G08G 1/08*** | (2006.01) |
| ***G08G 1/04*** | (2006.01) |

(52) U.S. Cl.
CPC ..... *G08G 1/0133* (2013.01); *G08G 1/04* (2013.01); *G08G 1/08* (2013.01); *G08G 1/081* (2013.01); *G08G 1/0967* (2013.01); *G08G 1/096716* (2013.01); *G08G 1/096725* (2013.01); *G08G 1/096758* (2013.01); *G08G 1/096775* (2013.01); *G08G 1/096783* (2013.01)

(58) Field of Classification Search
USPC ..... 701/117, 119; 340/935; 356/376
See application file for complete search history.

(56) References Cited

U.S. PATENT DOCUMENTS

| | | | | |
|---|---|---|---|---|
| 5,208,584 | A | 5/1993 | Kaye et al. | |
| 5,406,490 | A | 4/1995 | Braegas | |
| 5,444,442 | A | 8/1995 | Sadakata et al. | |
| 5,793,491 | A * | 8/1998 | Wangler | G01S 7/4802 356/398 |
| 6,064,139 | A | 5/2000 | Ozawa et al. | |
| 6,075,874 | A | 6/2000 | Higashikubo et al. | |
| 6,317,058 | B1 | 11/2001 | Lemelson et al. | |
| 6,366,219 | B1 | 4/2002 | Hoummady | |
| 6,405,132 | B1 | 6/2002 | Breed et al. | |
| 6,505,046 | B1 | 1/2003 | Baker | |
| 6,526,352 | B1 | 2/2003 | Breed et al. | |
| 6,720,920 | B2 | 4/2004 | Breed et al. | |
| 6,741,926 | B1 | 5/2004 | Zhao et al. | |
| 6,751,552 | B1 | 6/2004 | Minelli | |
| 6,768,944 | B2 | 7/2004 | Breed et al. | |
| 6,862,524 | B1 | 3/2005 | Nagda et al. | |
| 6,937,161 | B2 | 8/2005 | Nishimura | |
| 7,110,880 | B2 | 9/2006 | Breed et al. | |
| 7,610,146 | B2 | 10/2009 | Breed | |
| 7,630,806 | B2 | 12/2009 | Breed | |
| 7,698,055 | B2 | 4/2010 | Horvitz et al. | |
| 7,698,062 | B1 | 4/2010 | McMullen et al. | |
| 7,821,421 | B2 | 10/2010 | Tamir et al. | |
| 7,835,859 | B2 | 11/2010 | Bill | |
| 7,899,611 | B2 | 3/2011 | Downs et al. | |
| 7,979,172 | B2 | 7/2011 | Breed | |
| 8,050,863 | B2 | 11/2011 | Trepagnier et al. | |
| 8,135,505 | B2 | 3/2012 | Vengroff et al. | |
| 8,144,947 | B2 | 3/2012 | Kletter | |
| 8,212,688 | B2 | 7/2012 | Morioka et al. | |
| 8,255,144 | B2 | 8/2012 | Breed et al. | |
| 8,373,582 | B2 | 2/2013 | Hoffberg | |
| 8,566,029 | B1 | 10/2013 | Lopatenko et al. | |
| 8,589,069 | B1 | 11/2013 | Lehman | |
| 8,682,812 | B1 | 3/2014 | Ran | |
| 8,706,394 | B2 | 4/2014 | Trepagnier et al. | |
| 8,825,350 | B1 | 9/2014 | Robinson | |
| 8,903,128 | B2 | 12/2014 | Shet et al. | |
| 9,043,143 | B2 | 5/2015 | Han | |
| 9,387,928 | B1 | 7/2016 | Gentry et al. | |
| 9,965,951 | B1 | 5/2018 | Gallagher et al. | |
| 2004/0155811 | A1 | 8/2004 | Albero et al. | |
| 2005/0187708 | A1 | 8/2005 | Joe et al. | |
| 2007/0162372 | A1 | 7/2007 | Anas | |
| 2007/0208494 | A1 | 9/2007 | Chapman et al. | |
| 2007/0273552 | A1 | 11/2007 | Tischer | |
| 2008/0040023 | A1* | 2/2008 | Breed | B60N 2/2863 701/117 |
| 2008/0094250 | A1 | 4/2008 | Myr | |
| 2008/0195257 | A1 | 8/2008 | Rauch | |
| 2009/0048750 | A1 | 2/2009 | Breed | |
| 2009/0051568 | A1* | 2/2009 | Corry | G08G 1/081 340/935 |
| 2011/0037618 | A1 | 2/2011 | Ginsberg et al. | |
| 2011/0205086 | A1 | 8/2011 | Lamprecht et al. | |
| 2012/0038490 | A1 | 2/2012 | Verfuerth | |
| 2012/0112928 | A1 | 5/2012 | Nishimura et al. | |
| 2014/0136414 | A1 | 5/2014 | Abhyanker | |
| 2014/0195138 | A1* | 7/2014 | Stelzig | G08G 1/0116 701/119 |
| 2014/0277986 | A1 | 9/2014 | Mahler et al. | |
| 2017/0169309 | A1 | 6/2017 | Reddy et al. | |
| 2018/0075739 | A1 | 3/2018 | Ginsberg et al. | |
| 2018/0329428 | A1* | 11/2018 | Nagy | G05D 1/0287 |
| 2019/0049264 | A1 | 2/2019 | Malkes | |
| 2019/0050647 | A1 | 2/2019 | Malkes | |
| 2019/0051152 | A1 | 2/2019 | Malkes | |
| 2019/0051160 | A1 | 2/2019 | Malkes | |
| 2019/0051161 | A1 | 2/2019 | Malkes | |
| 2019/0051163 | A1 | 2/2019 | Malkes | |
| 2019/0051164 | A1 | 2/2019 | Malkes | |
| 2019/0051167 | A1 | 2/2019 | Malkes | |
| 2019/0051171 | A1 | 2/2019 | Malkes | |

FOREIGN PATENT DOCUMENTS

| | | |
|---|---|---|
| CN | 101944295 | 1/2011 |
| EP | 0 464 821 | 1/1992 |
| KR | 2013-0067847 | 6/2013 |

OTHER PUBLICATIONS

Dubska et al.; "Automatic Camera Calibration for Traffic Understanding", bmva.org, 2014.
Grosser, Kari; "Smart Io T Technologies for Adaptive Traffic Management Using a Wireless Mes Sensor Network", Advantech Industrial Io T Blog, Feb. 3, 2017.
https://www.flir.com, 2018.
Halper, Mark; Smart Cameras Will Help Spokane Light It's World More Intelligently (Updated), LEDs Magazine, and Business/Energy/Technology Journalist, Apr. 19, 2017.
Heaton, Brian; "Smart Traffic Signals Get a Green Light", Government Technology Magazine, Feb. 15, 2012.
Kolodny, Lora; Luminar reveals sensors that could make self-driving cars safer than human, Techcrunch, Apr. 13, 2017.
McDermott, John; "Google's newest secret weaon for local ads", Digiday, Jan. 29, 2014.
Resnick, Jim; "How Smart Traffic Signals May Ease Your Commute", BBC, Autos, Mar. 18, 2015.
Sun et al., M.; "Relating Things and Stuff Via Object Property Interactions", cvgl.stanford.edu, Sep. 4, 2012.
Whitwam, Ryan; "How Google's self-driving cars detect and avoid obstacles", ExtremeTech, Sep. 8, 2014.
Yamaguchi, Jun'ichi; "Three Dimensional Measurement Using Fisheye Stereo Vision", Advances in Theory and Applications of Stereo Vision, Dr. Asim Bhatti (Ed.), ISBN:978-953-307-516-7, InTech. Jan. 8, 2011.
U.S. Appl. No. 16/030,396 Office Action dated Nov. 20, 2018.
U.S. Appl. No. 16/058,343 Office Action dated Nov. 19, 2018.
U.S. Appl. No. 16/030,396, William A. Malkes, System and Method Adaptive Controlling of Traffic Using Camera Data, filed Jul. 9, 2018.
U.S. Appl. No. 16/044,891, William A. Malkes, System and Method for Controlling Vehicular Traffic, filed Jul. 25, 2018.
U.S. Appl. No. 16/032,886, William A. Malkes, Adaptive Traffic Control Using Object Tracking and Identity Details, filed Jul. 11, 2018.
U.S. Appl. No. 16/058,106, William A. Malkes, System and Method for Managing Traffic by Providing Recommendations to Connected Objects, filed Aug. 8, 2018.
U.S. Appl. No. 16/059,886, William A. Malkes, Systems and Methods of Adaptive Traffic Optimization Using Unmanned Aerial Vehicles, filed Aug. 9, 2018.
U.S. Appl. No. 16/058,214, William A. Malkes, System and Method of Adaptive Traffic Management, filed Aug. 8, 2018.

(56) References Cited

OTHER PUBLICATIONS

U.S. Appl. No. 16/100,750, William A. Malkes, System and Method of Adaptive Traffic Management at an Intersection, filed Aug. 10, 2018.
U.S. Appl. No. 16/101,766, William A. Malkes, System and Method for Retail Revenue Based Traffic Management, filed Aug. 10, 2018.
U.S. Appl. No. 16/101,933, William A. Malkes, Adaptive Optimization of Navigational Routes Using Traffic Data, filed Aug. 13, 2018.
U.S. Appl. No. 16/058,343, William A. Malkes, System and Method of Adaptive Controlling of Traffic Using Zone Based Occupancy, filed Aug. 8, 2018.

* cited by examiner

SYSTEM AND METHOD OF NAVIGATING VEHICLES

CROSS-REFERENCE TO RELATED APPLICATIONS

This application claims priority to U.S. Provisional Patent Application No. 62/544,551 filed on Aug. 11, 2017 and U.S. Provisional Patent Application No. 62/545,283 filed on Aug. 14, 2017, the entire content of each of which is incorporated herein by reference.

BACKGROUND

Field of the Disclosure

The present disclosure is generally related to navigation of vehicles, and more particularly related to detection of conditions that lead to changes in traffic patterns and communication of corresponding changes in navigation rules to objects detected by traffic control systems.

Description of the Related Art

Traffic control systems regulate the flow of traffic through intersections. Generally, traffic signals, comprising different color and/or shapes of lights, are mounted on poles or span wires at the intersection. These traffic signals are used to regulate the movement of traffic through the intersection by turning on and off their different signal lights. These signals, together with the equipment that turns on and off their different lights, comprise a traffic control system. In cities, the amount of traffic is vast and thus movement in multiple directions is allowed for fast discharge of vehicles to prevent traffic congestion. Despite providing such mechanisms, traffic control systems fail to avoid traffic congestion, particularly during the peak hours and during inclement weather.

Further, while obstructions occur or are present on the roads, the traffic control systems fail completely to guide the vehicles. Such obstructions may refer to the occurrence of an accident, the presence of potholes, and/or restricted access due to maintenance or construction. During such conditions, each driver follows a path that he/she feels is best to move ahead in a particular condition. Such random and diverse movements of vehicles on the roads lead to traffic congestion. These obstructions become even more problematic with the increased presence of autonomous vehicles on the roads and thus communication of changes in traffic rules become very important.

Thus, the current state of art lacks a method of navigating the vehicles during occurrence of obstructions or adverse conditions on the roads and an efficient method to address such issue is desired.

SUMMARY

One or more example embodiments of inventive concepts are directed to detection of conditions that lead to changes in traffic patterns and communication of corresponding changes in navigation rules to objects detected by traffic control systems.

One aspect of the present disclosure is a method of traffic control including receiving, by a processor, traffic data at an intersection; determining, by the processor, an average path taken by one or more objects at the intersection; determining, by the processor, a deviation of the average path from a historical average path; based on the deviation, determining by the processor, a traffic rule is to be implemented for incoming objects; and communicating, by the processor, the traffic rule to the incoming objects.

One aspect of the present disclosure is a traffic controller with memory having computer-readable instructions stored thereon and one or more processors. The one or more processors are configured to execute the computer-readable instructions to receive traffic data at an intersection; determine an average path taken by one or more objects at the intersection; determine a deviation of the average path from a historical average path; based on the deviation, determine a traffic rule is to be implemented for incoming objects; and communicate the traffic rule to the incoming objects.

One aspect of the present disclosure includes one or more non-transitory computer-readable medium having computer-readable instructions stored thereon, which when executed by one or more processors, cause the one or more processors to receive traffic data at an intersection; determine an average path taken by one or more objects at the intersection; determine a deviation of the average path from a historical average path; based on the deviation, determine a traffic rule is to be implemented for incoming objects; and communicate the traffic rule to the incoming objects.

BRIEF DESCRIPTION OF THE DRAWINGS

The accompanying drawings illustrate various embodiments of systems, methods, and embodiments of various other aspects of the disclosure. Any person with ordinary skills in the art will appreciate that the illustrated element boundaries (e.g. boxes, groups of boxes, or other shapes) in the figures represent one example of the boundaries. It may be that in some examples one element may be designed as multiple elements or that multiple elements may be designed as one element. In some examples, an element shown as an internal component of one element may be implemented as an external component in another, and vice versa. Furthermore, elements may not be drawn to scale. Non-limiting and non-exhaustive descriptions are described with reference to the following drawings. The components in the figures are not necessarily to scale, emphasis instead being placed upon illustrating principles.

DETAILED DESCRIPTION

Specific details are provided in the following description to provide a thorough understanding of embodiments. However, it will be understood by one of ordinary skill in the art that embodiments may be practiced without these specific details. For example, systems may be shown in block diagrams so as not to obscure the embodiments in unnecessary detail. In other instances, well-known processes, structures and techniques may be shown without unnecessary detail in order to avoid obscuring embodiments.

Although a flow chart may describe the operations as a sequential process, many of the operations may be performed in parallel, concurrently or simultaneously. In addition, the order of the operations may be re-arranged. A process may be terminated when its operations are completed, but may also have additional steps not included in the figure. A process may correspond to a method, function, procedure, subroutine, subprogram, etc. When a process corresponds to a function, its termination may correspond to a return of the function to the calling function or the main function.

Example embodiments of the present disclosure will be described more fully hereinafter with reference to the accompanying drawings in which like numerals represent like elements throughout the several figures, and in which example embodiments are shown. Example embodiments of the claims may, however, be embodied in many different forms and should not be construed as limited to the example embodiments set forth herein. The examples set forth herein are non-limiting examples and are merely examples among other possible examples.

Figure 1:
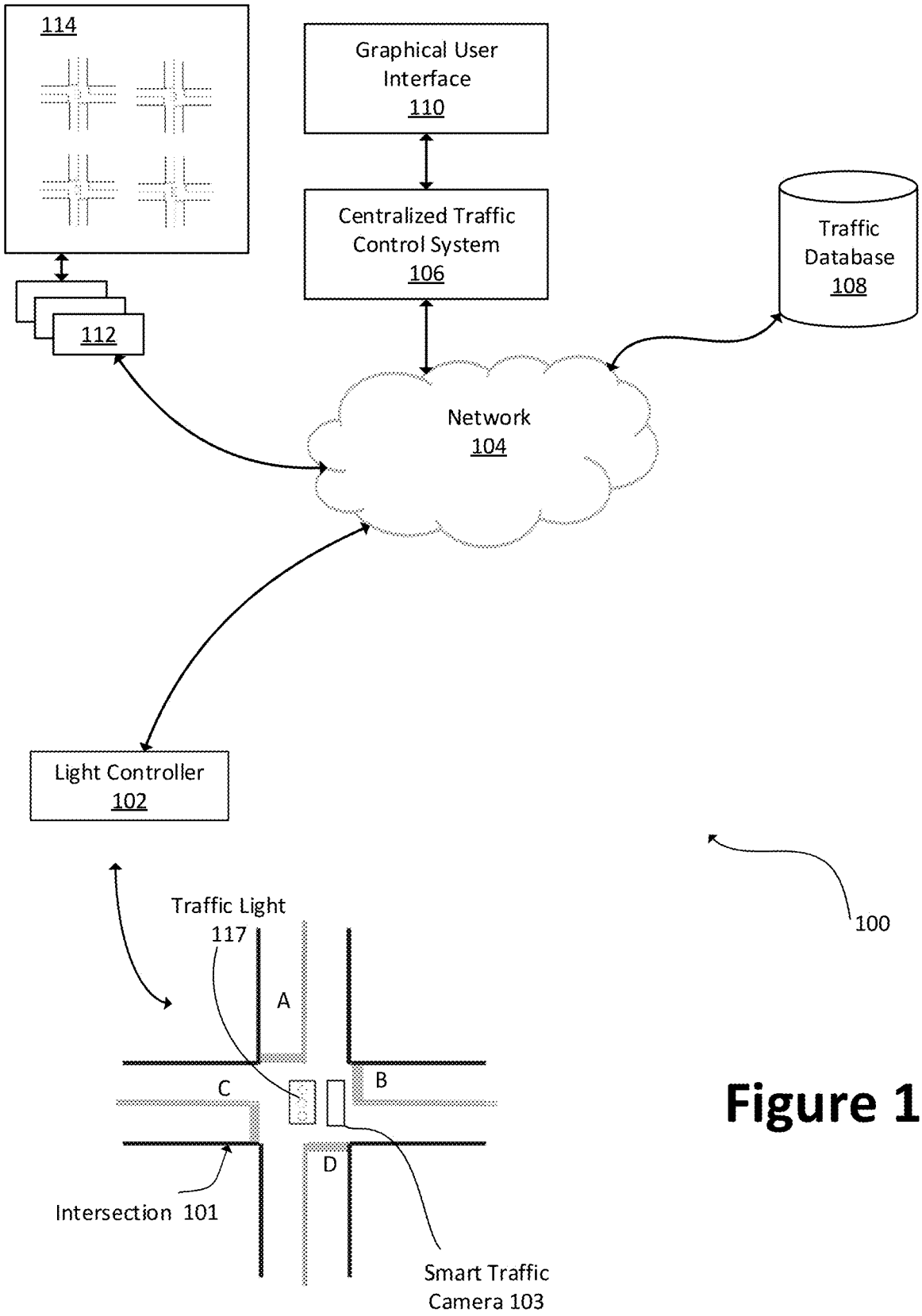
FIG. 1 illustrates a system for controlling traffic.

FIG. 1 illustrates a system for controlling traffic. The system 100 can have various components including but not limited to, a traffic light controller 102 (hereinafter may be referred to as a light controller 102) associated with a smart traffic camera 103 and traffic light 117 installed at an intersection 101. The light controller 102 may be configured to receive traffic rules from a traffic controller 106 and control the smart traffic camera 103 and/or the traffic light 117 to implement the same and/or implement light phases according to the traffic rules. The light controller 102 may or may not be physically located near (or at the same location as) the smart traffic camera 103 and/or the traffic light 117. The light controller 102, the smart traffic camera 103 and the traffic light 117 may be the same physical unit implementing functionalities of both.

There may be more than one smart traffic camera 103 or one traffic light 117 installed at intersection 101. The smart traffic camera 103 may be one various types of cameras, including but not limited, to fisheye traffic cameras to detect and optimize traffic flows at the intersection 101 and/or at other intersections part of the same local network or corridor. The smart traffic camera 103 can be any combination of cameras or optical sensors, such as but not limited to fish-eye cameras, directional cameras, infrared cameras, etc. The smart traffic camera 103 can allow for other types of sensors to be connected to thereto (e.g., via various known or to be developed wired and/or wireless communication schemes) for additional data collection. The smart traffic camera 103 can collect video and other sensor data at the intersection 101 and convey the same to the traffic controller 102 for further processing, as will be described below.

The traffic light 117 and/or the smart traffic camera 103 can manage and control traffic for all zones (directions) at which traffic enters and exits the intersection 101. Examples of different zones of the intersection 101 are illustrated in FIG. 1 (e.g., zones A, B, C and D). Therefore, while FIG. 1 only depicts a single smart traffic camera 103 and a single traffic light 117, there can be multiple ones of the smart traffic camera 103 and the traffic light 117 installed at the intersection 101 for managing traffic for different zones of the intersection 101.

The system 100 may further include network 104. The network 104 can enable the light controller 102 to communicate with the traffic controller 106 (a remote traffic control system 106). The network 104 can be any known or to be developed cellular, wireless access network and/or a local area network that enables communication (wired or wireless) among components of the system 100. The light controller 102 and the traffic controller 106 can communicate via the network 104 to exchange data, create traffic rules or control settings, etc., as will be described below.

The remote traffic control system 106 can be a centralized system used for managing and controlling traffic lights and conditions at multiple intersections (in a given locality, neighborhood, an entire town, city, state, etc.). The remote traffic control system 106 can also be referred to as the centralized traffic control system 106, the traffic control system 106 or simply the traffic controller 106, all of which can be used interchangeably throughout the present disclosure.

The traffic controller 106 can be communicatively coupled (e.g., via any known or to be developed wired and/or wireless network connection such as network 104) to one or more databases such as a traffic database 108, which may store traffic data collected and analyzed for intersection 101 and/or any number of other intersection, roads, highways, etc. The use of traffic database 108 will be further described below.

In one example, the traffic database 108 described above may be associated with the traffic controller 106 and may be co-located and co-operated with traffic controller 106. Alternatively, the traffic database 108 may be remotely located from the traffic controller 106 and accessible via the network 104 as shown in FIG. 1.

Referring back to the traffic controller 106, the traffic controller 106 can provide a centralized platform for network operators to view and manage traffic conditions, set traffic control parameters and/or manually override any traffic control mechanisms at any given intersection. An operator can access and use the traffic controller 106 via a corresponding graphical user interface 110 after providing logging credentials and authentication of the same by the traffic controller 106. The traffic controller 106 can be controlled, via the graphical user interface 110, by an operator to receive traffic control settings and parameters to apply to one or more designated intersections. The traffic controller 106 can also perform automated and adaptive control of traffic at the intersection 101 or any other associated intersection based on analysis of traffic conditions, data and statistics at a given intersection(s) using various algorithms and computer-readable programs such as known or to be developed machine learning algorithms. The components and operations of traffic controller 106 will be further described below with reference to FIGS. 2-6.

Traffic controller 106 can be a cloud based component running on a public, private and/or a hybrid cloud service provided by one or more cloud service providers.

The system 100 can also have additional intersections and corresponding light controllers associated therewith. Accordingly, not only the traffic controller 106 is capable of adaptively controlling the traffic at an intersection based on traffic data at that particular intersection but it can further adapt traffic control parameters for that particular intersection based on traffic data and statistics at nearby intersections communicatively coupled to the traffic controller 106.

As shown in FIG. 1, the light controllers 112 can be associated with one or more traffic lights at one or more of the intersections 114 and can function in a similar manner as the light controller 102 and receive traffic control settings from the traffic controller 106 for managing traffic at the corresponding one of the intersections 114. Alternatively, any one of the light controllers 112 can be a conventional light controller implementing pre-set traffic control settings at the corresponding traffic lights but configured to convey corresponding traffic statistics to the traffic controller 106.

The intersections 114 can be any number of intersections adjacent to the intersection 101, within the same neighborhood or city as the intersection 101, intersections in another city, etc.

In one or more examples, the light controller 102 and the traffic controller 106 can be the same (one component implementing the functionalities of both) and may be physically located near the intersection 101. In such example, components of each described below with reference to FIGS. 2 and 3 may be combined into one. Furthermore, in such example, the light controller 102 may be remotely located relative to the smart traffic camera 103 and/or the traffic light 117 and be communicatively coupled thereto over a communication network such as the network 104.

As mentioned above, the components of the system 100 can communicate with one another using any known or to be developed wired and/or wireless network. For example, for wireless communication, techniques such as Visible Light Communication (VLC), Worldwide Interoperability for Microwave Access (WiMAX), Long Term Evolution (LTE), Fifth Generation (5G) Cellular, Wireless Local Area Network (WLAN), Infrared (IR) communication, Public Switched Telephone Network (PSTN), Radio waves, and other communication techniques known in the art may be utilized.

While certain components of the system 100 are illustrated in FIG. 1, inventive concepts are not limited thereto and the system 100 may include any number of additional components necessary for operation and functionality thereof. For example, the traffic controller 106 can have any known or to be developed communication component(s) for communicating with other components of the system 100 and/or objects such as mobile devices and autonomous cars detected at the intersection 101. The light controller 102 can also have the same communication component(s) as the traffic controller 106.

Having described components of an example system 100, the disclosure now turns to description of one or more examples of components of the traffic controller 106 and the light controller 102.

Figure 2:
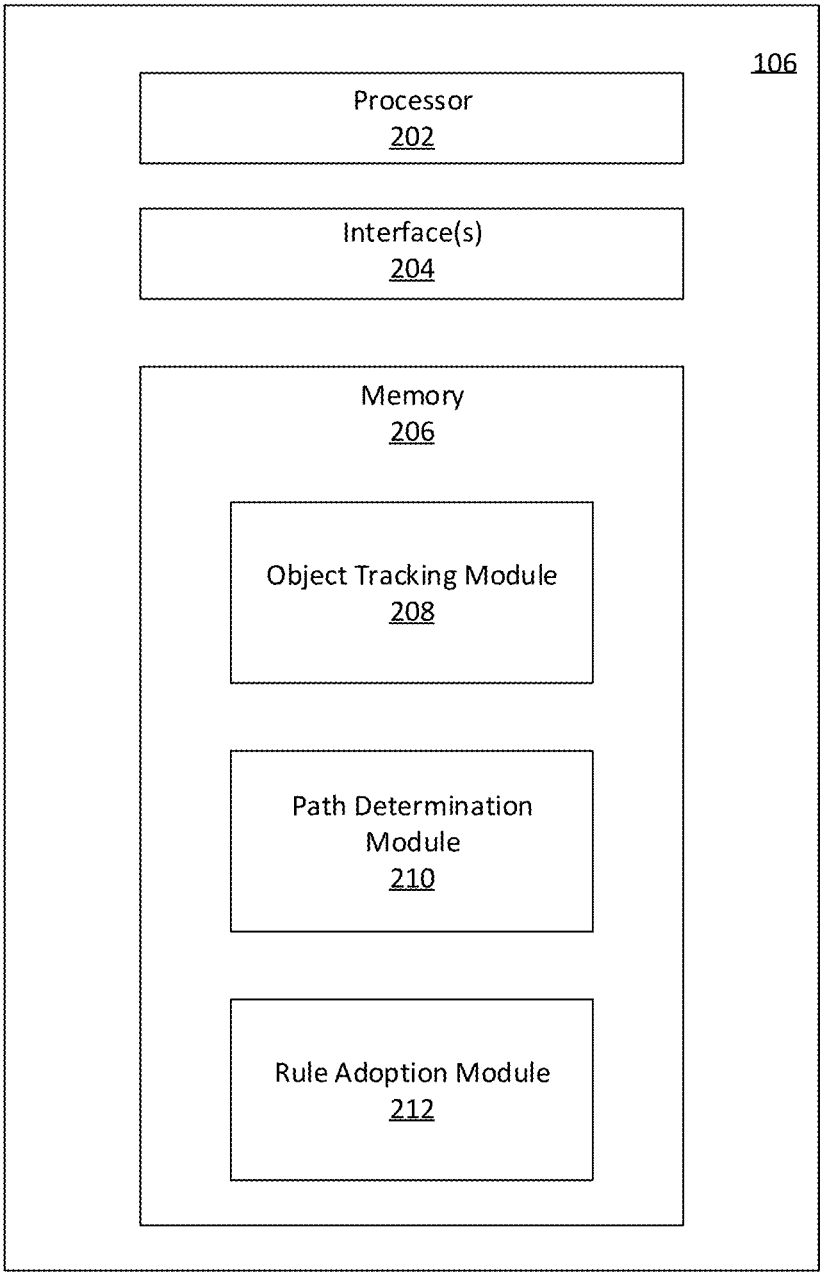
FIG. 2 is a block diagram showing different components of the traffic controller of FIG. 1.

FIG. 2 is a block diagram showing different components of the traffic controller of FIG. 1.

The traffic controller 106 can comprise one or more processors such as a processor 202, interface(s) 204 and one or more memories such as a memory 206. The processor 202 may execute an algorithm stored in the memory 206 for determining and communicating traffic rule changes to objects detected at an intersection. The processor 202 may also be configured to decode and execute any instructions received from one or more other electronic devices or server(s). The processor 202 may include one or more general purpose processors (e.g., INTEL® or Advanced Micro Devices® (AMD) microprocessors, ARM) and/or one or more special purpose processors (e.g., digital signal processors, Xilinx® System On Chip (SOC) Field Programmable Gate Array (FPGA) processor, and/or Graphics Processing Units (GPUs)). The processor 202 may be configured to execute one or more computer-readable program instructions, such as program instructions to carry out any of the functions described in this description.

The interface(s) 204 may assist an operator in interacting with the traffic controller 106. The interface(s) 204 of the traffic controller 106 can be used instead of or in addition to the graphical user interface 116 described above with reference to FIG. 1. In another example, the interface(s) 204 can be the same as the graphical user interface 116. The interface(s) 204 either accept an input from the operator or provide an output to the operator, or may perform both the actions. The interface(s) 204 may either be a Command Line Interface (CLI), Graphical User Interface (GUI), voice interface, and/or any other user interface known in the art or to be developed.

The memory 206 may include, but is not limited to, fixed (hard) drives, magnetic tape, floppy diskettes, optical disks, Compact Disc Read-Only Memories (CD-ROMs), and magneto-optical disks, semiconductor memories, such as ROMs, Random Access Memories (RAMs), Programmable Read-Only Memories (PROMs), Erasable PROMs (EPROMs), Electrically Erasable PROMs (EEPROMs), flash memory, magnetic or optical cards, or other type of media/machine-readable medium suitable for storing electronic instructions.

The memory 206 may include computer-readable instructions, which when executed by the processor 202 cause the traffic controller 106 to determine traffic rule changes and communicate the changes to incoming objects and vehicles detected at the intersection 101. The computer-readable instructions stored in the memory 206 can be identified as object tracking module (service) 208, a path determination module (service) 210, and a rule adoption module (service) 212. The functionalities of each of these modules, when executed by the processor 202 will be further described below with reference to FIGS. 4-6.

Figure 3:
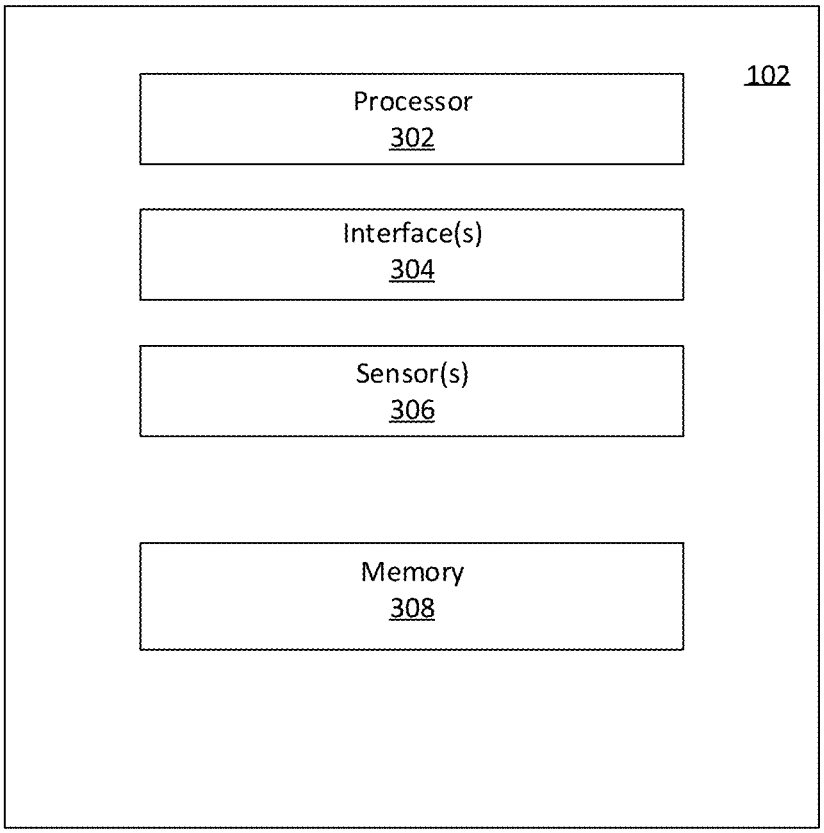
FIG. 3 is a block diagram showing different components of the light controller of FIG. 1.

FIG. 3 is a block diagram showing different components of the light controller of FIG. 1. As mentioned above, the light controller 102 can be physically located near the smart traffic camera 103 and/or the traffic light 117 (e.g., at a corner of the intersection 101) or alternatively can communicate with the smart traffic camera 103 or the traffic light 117 wirelessly or via a wired communication scheme (be communicatively coupled thereto).

The light controller 102 can comprise one or more processors such as a processor 302, interface(s) 304, sensor(s) 306, and one or more memories such as a memory 308. The processor 302 may execute an algorithm stored in the memory 308 for implementing traffic control rules, as provided by traffic controller 106. The processor 302 may also be configured to decode and execute any instructions received from one or more other electronic devices or server(s). The processor 302 may include one or more general purpose processors (e.g., INTEL® or Advanced Micro Devices® (AMD) microprocessors, ARM) and/or one or more special purpose processors (e.g., digital signal processors, Xilinx® System On Chip (SOC) Field Programmable Gate Array (FPGA) processor, and/or Graphics Processing Units (GPUs)). The processor 302 may be configured to execute one or more computer-readable program instructions, such as program instructions to carry out any of the functions described in this description.

The interface(s) 304 may assist an operator in interacting with the light controller 102. The interface(s) 304 of the light controller 102 may be used instead of or in addition to the graphical user interface 110 described with reference to FIG. 1. In one example, the interface(s) 304 can be the same as the graphical user interface 110. The interface(s) 304 either accept an input from the operator or provide an output to the operator, or may perform both actions. The interface(s) 304 may either be a Command Line Interface (CLI), Graphical User Interface (GUI), voice interface, and/or any other user interface known in the art or to be developed.

The sensor(s) 306 can be one or more smart cameras such as fish-eye cameras mentioned above or any other type of sensor/capturing device that can capture various types of data (e.g., audio/visual data) regarding activities and traffic patterns at the intersection 101. Any one such sensor 306 can be located at/attached to the light controller 102, located at/attached to the smart traffic camera 103 and/or the traffic light 117 or remotely and communicatively coupled thereto via the network 104.

As mentioned, the sensor(s) 306 may be installed with the traffic light 117, near the traffic light 117 or at/near the intersection 101 to capture objects moving across the roads. The sensor(s) 306 used may include, but are not limited to, optical sensors such as fish-eye camera mentioned above, Closed Circuit Television (CCTV) camera and Infrared camera. Further, sensor(s) 306 can include, but not limited to induction loops, Light Detection and Ranging (LIDAR), radar/microwave, weather sensors, motion sensors, audio sensors, pneumatic road tubes, magnetic sensors, piezoelectric cable, and weigh-in motion sensor, which may also be used in combination with the optical sensor(s) or alone.

The memory 308 may include, but is not limited to, fixed (hard) drives, magnetic tape, floppy diskettes, optical disks, Compact Disc Read-Only Memories (CD-ROMs), and magneto-optical disks, semiconductor memories, such as ROMs, Random Access Memories (RAMs), Programmable Read-Only Memories (PROMs), Erasable PROMs (EPROMs), Electrically Erasable PROMs (EEPROMs), flash memory, magnetic or optical cards, or other type of media/machine-readable medium suitable for storing electronic instructions.

The memory 308 may include computer-readable instructions, which when executed by the processor 302 cause the light controller 102 to implement traffic control rules as provided by traffic controller 106.

As mentioned above, the light controller 102 and the traffic controller 106 may form a single physical unit, in which case system components of each, as described with reference to FIGS. 1 to 3 may be combined into one (e.g., all example modules described above with reference to FIGS. 2 and 3 may be stored on a single memory such as the memory 206 or the memory 308).

While certain components have been shown and described with reference to FIGS. 2 and 3, the components of the light controller 102 and/or the traffic controller 106 are not limited thereto, and can include any other component for proper operations thereof including, but not limited to, a transceiver, a power source, etc.

Figure 4:
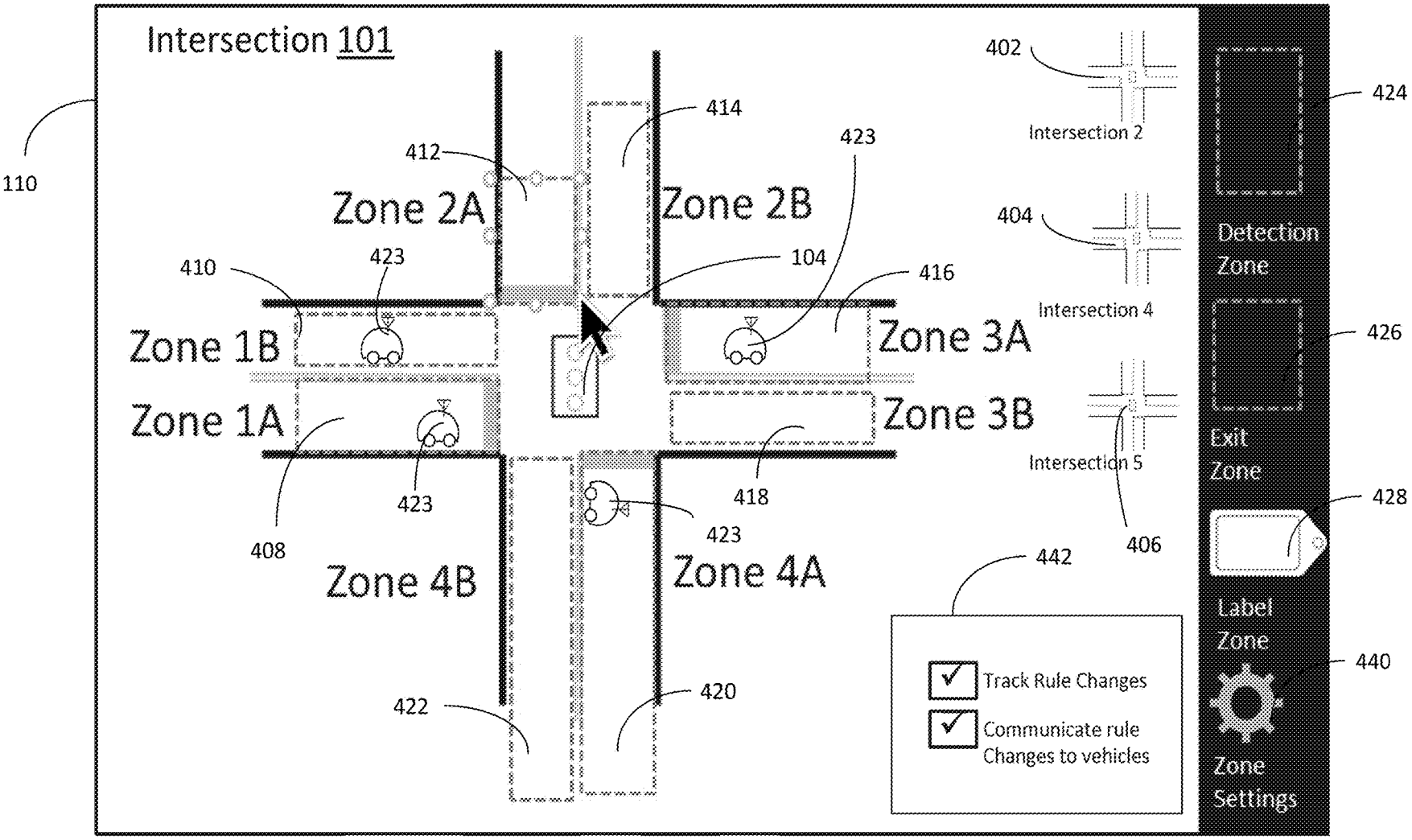
FIG. 4 illustrates a Graphical User Interface (GUI) for allowing an operator to define detection zones in an intersection, for detecting objects entering, objects exiting, and objects approaching the intersection.

FIG. 4 illustrates a Graphical User Interface (GUI) for allowing an operator to define detection zones in an intersection, for detecting objects entering, objects exiting, and objects approaching the intersection.

In one example embodiment, the GUI 110 may allow an operator of the system 100 to view an intersection such as the intersection 101 and define detection zones therefore. Using the GUI 110, the operator may select one intersection amongst many intersections of other roads. The GUI 110 may receive live sensor data from sensor(s) 306 associated with the light controller 102 and/or from the smart traffic camera 103 at the intersection 101.

In one example, the operator may select the intersection 101 as shown in FIG. 4. GUI 110 can also include "thumbnails" of other nearby intersections such as thumbnails 402, 404 and 406 representing a few of nearby intersections 114, each of which may be selected by an operator to be viewed and/or have parameters thereof specified.

Upon selecting the intersection 101 and receiving video and image data from the sensors 306 corresponding to the intersection 101, the operator may draw and label detection zones for detecting and tracking traffic at the intersection 101. For example, as shown in FIG. 4, the operator may label each side of intersection 101 as either a detection zone (from which objects and vehicles approach the intersection 101) or an exit zone (from which objects exit the intersection 101). In FIG. 4, these zones are labeled as detection zone 1A 408, exit zone 1B 410, detection zone 2A 412, exit zone 2B 414, detection zone 3A 416, exit zone 3B 418, detection zone 4A 420 and exit zone 4B 422. The labeling may be made using via label zone button (tool) 328. Marks 424 and 426 can be identifiers for distinguishing detection zones from exit zones, respectively.

The operator may also be able to customize settings of the zones of the selected intersection 101, using a 'zone settings' tab 440. In one example, the operator may modify default control settings for each zone, such as, but not limited to, changing default phase times for each zone and changing phase times based on traffic, where phase time may refer to a duration of a particular light color at the intersection 101 such as red light, green light, yellow light, etc. The operator may also enable or disable options 442 including enabling traffic rule changes and communicating rule changes to vehicles/objects, both of which will be described below. For purposes of example embodiments described herein, an assumption is made that options 442 are selected.

One or more objects 423 are also shown at the intersection 101 either approaching the intersection 101 via a detection zone or exiting the intersection 101 via an exit zone. The one or more objects 423 can be any type of object detected at the intersection 101 including, but not limited to, pedestrians (e.g., via one or more electronic devices associated therewith such as mobile phones, etc.), cars, trucks, motorcycles, bicycles, autonomous transport/moving objects and vehicles. Furthermore, cars, trucks, buses and bikes can further be broken down into sub-categories. For example, cars can be categorized into sedans, vans, SUVs, etc. Trucks can be categorized into light trucks such as pickup trucks, medium trucks such as box trucks or fire trucks, heavy duty trucks such as garbage trucks, crane movers, 18-wheelers, etc.

Having described examples of traffic control systems and components thereof such as the system 100, the light controller 102 and the traffic controller 106 with reference to FIGS. 1-3 as well as examples for identifying zones and corresponding traffic control variables at the intersection 101 with reference to FIG. 4, the disclosure now turns to example embodiments of detecting changes in traffic patterns, establishing traffic rules therefor and communicating the same to objects such as the objects 423 at the intersection 101.

As indicated above, obstructions occur or are present on the roads. The obstructions refer to occurrence of an accident, the presence of potholes, and/or restricted access due to maintenance, construction, a scheduled event, etc. During such conditions, each driver of a vehicle or each autonomous vehicle follows a path that he/she/it feels is best to follow in a particular condition. Such random and diverse movements of vehicles on the roads lead to traffic congestion. These obstructions become even more problematic with the increased presence of autonomous vehicles on roads and thus timely communication of changes in traffic movement and rules become very important in order to ensure safe and efficient movement of vehicles approaching and exiting an intersection.

Figure 5:
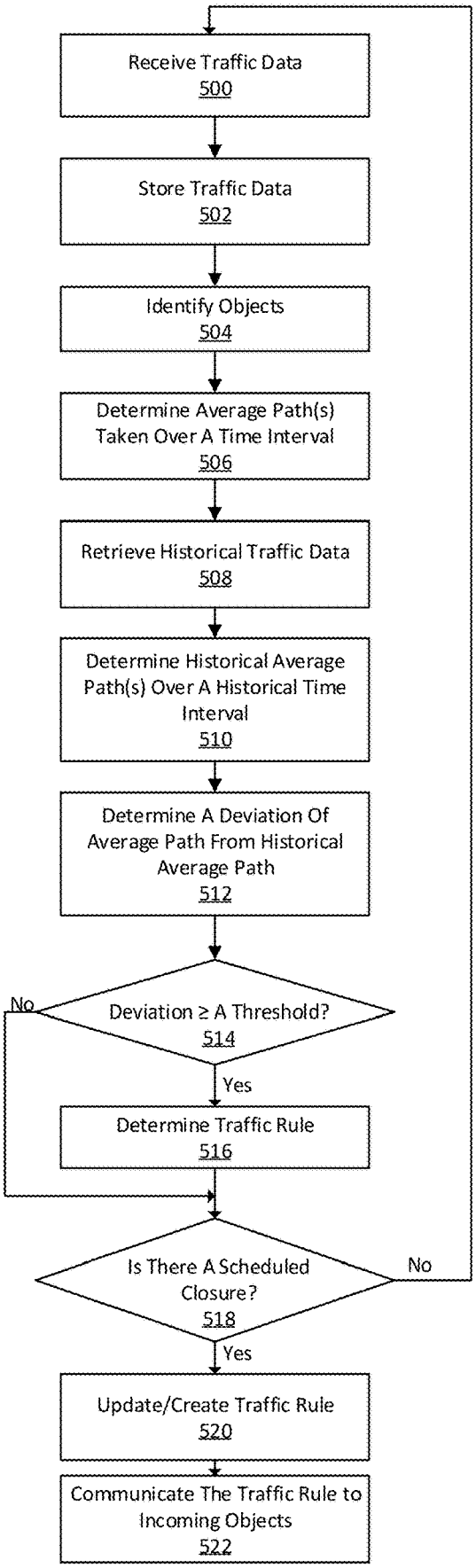
FIG. 5 illustrates a flowchart of a method executed by the traffic controller of FIG. 1.

FIG. 5 illustrates a flowchart of a method executed by the traffic controller of FIG. 1. One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed example embodiments.

Furthermore, FIG. 5 will be described from the perspective of the traffic controller 106. However, it will be understood that the functionalities of the traffic controller 106 are implemented by the processor 202 executing computer-readable instructions stored on the memory 206 described with reference to FIG. 2.

At step 500, the traffic controller 106 may receive traffic data at the intersection 101. The traffic data may be collected by the smart traffic camera and/or sensor(s) 206 of the light controller 102 and communicated over the network 104 to the traffic controller 106. Alternatively and when the traffic controller 106 is located at the intersection 101 (e.g., when the traffic controller 106 and the light controller 102 are the same), the traffic data collected by the smart traffic camera 103 and/or the sensor(s) 206 will be sent to the traffic controller 106 over any know or to be developed communication scheme such as the network 104 or a short range wireless communication protocol or a wired communication medium. The traffic data may be video, image, sound and/or any other type of data that may convey information regarding the traffic at the intersection 101.

In one example, the traffic data can include any type of object present at the intersection including, but not limited to, pedestrians, cars, trucks, motorcycles, bicycles, autonomous transport/moving objects and vehicles. Furthermore, cars, trucks, buses and bikes can further be broken down into sub-categories. For example, cars can be categorized into sedans, vans, SUVs, etc. Trucks can be categorized into light trucks such as pickup trucks, medium trucks such as box trucks or fire trucks, heavy duty trucks such as garbage trucks, crane movers, 18-wheelers, etc.

In one example, traffic data can also include traffic data of other adjacent and/or nearby intersections provided via corresponding smart traffic lights or light controllers such as the light controllers 118 of FIG. 1.

At step 502, the traffic controller 106 may store the received traffic data in the traffic database 108. Alternatively, the traffic data captured by the smart traffic camera 103 and/or sensors 306 of the light controller 102 can be directly sent to and stored in the traffic database 108. The traffic data may be continuously captured and stored in the traffic database 108.

At step 504, the traffic controller 104 may implement the computer-readable instructions corresponding to the object tracking module 208, to analyze the received video data in order to identify and track the objects in the traffic data at the intersection 101. The detection of the types of vehicles can be based on any known or to be developed method of image/video processing for detecting objects in video/image data. In one example, salient points assigned to each object are tracked via optical flow as each object moves through a given zone at the intersection 101 such as the zones 408-422 described with reference to FIG. 4.

In one example, the traffic controller may assign a type to each identified object (car) (associates each identified object with one of a plurality of object types) and may then determine a number of the detected objects having the same object type (e.g., the number of cars, the number of trucks, etc.).

At step 506, the traffic controller 106 may implement the computer-readable instructions corresponding to the path determination module 210 to determine a recent average path taken by objects tracked at the intersection 101 at the step 504. In one example, the recent average path may be determined over a time interval, duration of which may be a configurable parameter determined based on experiments and/or empirical studies. For example, the recent average path may be determined over a period of 5 minutes, 15 minutes, 30 minutes, 1 hour, 6 hours, 12 hours, 24 hours, a week, etc.

In one example, the traffic controller 106 may determine a recent and per-zone average path for each detection and/or exit zone (e.g., zones 408-422 in FIG. 4) taken by detected object in that particular section. In one example, different time intervals may be used for different zones of the intersection 101. In one example, the traffic controller 106 may determine a recent average path for the entire intersection 101 based on detected objects in all detection and/or exist zones. In another example, the traffic controller 106 may determine a recent average path for some of the zones (a subset of the zones) at the intersection 101 (e.g., the zones 408 and 410 or the zones 416 and 420, etc.).

At step 508, the traffic controller 106 may retrieve traffic data (historical traffic data) from the traffic database 108. This data, as indicated above, may be continuously captured by the smart traffic camera 103 and/or the sensors 306 and stored in the traffic database 108.

At step 510, the traffic controller 106 may implement the computer-readable instructions corresponding to the path determination module 210 to determine historical average path(s) taken by objects at the intersection 101. This historical average path(s) may be determined over a time interval (historical time interval) that is relatively longer compared to the time interval used at step 506. For example, when the time interval used at step 506 is an hour, then the historical time interval may be 24 hours, a week, a month, a year, etc. In another example, when the time interval used at step 506 is 24 hours, then the historical time interval may be a month, two months, 6 months, a year, etc. The historical time interval may be a configurable parameter, duration of which may be determined based on experiments and/or empirical studies.

In one example, for each zone of the intersection 101 (and/or alternatively, a subset of the zones or the entirety of the intersection 101), for which a recent average path is determined at step 506, the traffic controller 106 may determine a corresponding historical average path (e.g., zones 408-422 in FIG. 4) at step 510 based on corresponding data stored in the traffic database 108. In one example, different historical time intervals may be used for different zones of the intersection 101.

In one example, at steps 506 and 510, the traffic controller 106 can use any known or to be developed method for determining the recent average path and the historical average path. For example, the traffic controller 106 can assign decision points to each zone of the intersection 101 and determine links between such decision points as objects traverse therethrough.

At step 512, the traffic controller 106 may determine a deviation of the recent average path determined at step 506 from the historical average path determined at step 510. In one example and for each zone of the intersection 101 (and/or alternatively, a subset of the zones or the entirety of the intersection 101), the traffic controller 106 determines the deviation of the corresponding recent average path determined at step 506 from the corresponding historical average path determined at step 510.

At step 514, the traffic controller 106 determines if the deviation is equal to or greater than a threshold, where the threshold is a configurable parameter determined based on experiments and/or empirical studies. For example, the threshold may be set to 20% meaning that the controller 106 determines if the recent average path determined at step 506 deviates 20% or more from the corresponding historical average path determined at step 510.

If the deviation is determined to be less than the threshold (No at step 514), then the process proceeds to step 518, which will be described below. However, if at step 514 the traffic controller 106 determines that the deviation is equal to or greater than the threshold (Yes at step 514), then at step 516, the traffic controller 106 may determine a traffic rule (a rule change) by implementing computer-readable instructions corresponding to the rule adoption module 212. In one example, a deviation that is equal to or greater than the threshold, may be indicative of an obstruction in one or more zones of the intersection 101, where the obstruction may be any one of, but not limited to, potholes, construction or road repair, an accident, inclement weather, slow movement of traffic, detouring, and emergency routing, etc. Visual examples of such obstructions and corresponding rules are provided in FIG. 6, which will be described below.

The rule determined at step 516 may be a rule based on which objects at the intersection 101 are directed to take an alternative path, where the alternative path may be a path that would otherwise (absent the detection of the obstruction) be inaccessible to and/or not permissible for objects to travel through. For example, as a result of steps 500-512, the traffic controller 106 may determine that an obstruction (e.g., a pothole) exists in the zone 416 of the intersection 101 and that the object 423 approaching the intersection 101 in the zone 416 needs to avoid the obstruction. Accordingly, at step 516, the traffic controller 106 may determine a traffic rule whereby the object 423 detected in the zone 416 is to take an alternative path (e.g., deviate to zone 418, which under normal condition would not available to the detected object 423 in the zone 416) to avoid the obstruction and return back to its normal route after avoiding the obstruction.

In another example, the obstruction may exist in zones 416 and 418 (e.g., a large pothole covering both of the zones 416 and 418) of the intersection, such that objects approaching the intersection 101 or intending to exit the intersection 101 via the zone 418 may be affected. Therefore, at step 516, the traffic controller 106 may determine a traffic rule such that all objects 423 at the intersection 101 take alternative paths to avoid the zones 416 and 418. In such example, object 423 shown in the zone 416 in FIG. 4 may be instructed to turn around and take an alternative path that does not pass through the intersection 101 (avoid the intersection 101).

In one example, the traffic controller 106 may determine the alternative path for the traffic rule by looking at historical data stored in the traffic database 108 that may indicate what alternative paths were typically taken by objects when similar obstructions were detected in the past. Alternatively, the traffic controller 106 may look at the average rate of traffic flow (e.g., instantaneous flow rate or a flow rate for a period of time corresponding to a time period over which the obstruction is detected) in adjacent zone(s) and select the alternative path through one or more zones (or lanes thereof) having a corresponding traffic flow rate that is greater than a threshold (indicative of relatively light traffic therethrough) such that redirecting the traffic in a affected zone with obstruction to travel through such adjacent zone would cause relatively small disruption in normal traffic flows through the adjacent zone(s) and/or the intersection 101 in general (e.g., would cause a disruption that does not reduce a corresponding traffic flow rate in the adjacent zone(s) by more than 50%).

In one example at step 516, and in addition to determining a traffic rule for vehicles in an affected zone(s) (zone(s) in which an obstruction is detected at step 514), the traffic controller 106 may also determine applicable traffic rules/guidelines for objects in one or more zones adjacent to the affected zone because redirecting the traffic in the affected zone to take alternative path(s) through adjacent zones can adversely affect the already existing traffic/flow rate in the adjacent zones. Therefore, the traffic controller 106 can also create a communication for incoming objects in the adjacent zone(s) informing such incoming objects that due to an obstruction in the affected zone (one or more lanes thereof) the lanes of the adjacent zone(s) may be shared by the traffic in both directions. For example, communications may be sent to traffic traveling through the zone 418 that vehicles in the zone 416 may use lanes of the zone 418 as an alternative path to avoid an obstruction detected in the zone 416 and that objects traveling through the zone 418 should slow down and be cautious to ensure they do not collide with objects of zone 416 that are using the lanes of the zone 418 as an alternative path. In one example, such warning can include a specific rule. For example, the traffic controller 106 may generate a traffic rule whereby all vehicles approaching the zone 418 after passing through the intersection 101, are to make a complete stop for a period of 10 seconds and search for any incoming vehicle and in the absence of detecting any incoming vehicle after 10 seconds, may proceed with traveling through the zone 418.

At step 518, the traffic controller 106 may determine if there is a scheduled closure associated with the intersection 101 and/or roads leading to the intersection 101. A scheduled closure may be due to various reasons including, but not limited to, a scheduled public event (e.g., a rally, a concert, etc.) requiring road closure or at least one lane closure, a scheduled road work maintenance, an upcoming weather condition, etc.

In one example, the traffic controller 106 may determine the scheduled closure by accessing an external database containing such road closure schedules. This may be a public or private database provided by a third party (e.g., Google Maps, a local government or city database, etc.).

If at step 518, the traffic controller 106 determines that there is no scheduled closure for the intersection 101 and/or roads leading thereto, then the process reverts back to step 500 and traffic controller 106 repeats steps 500 to 518.

However, if at step 518, the traffic controller 106 determines that there is a scheduled closure, then at step 520, the traffic controller can either creates (determines) a new traffic rule (if no traffic rule is determined at step 516) or updates/adjusts the traffic rule determined at step 516.

For example, at step 516, the traffic controller 106 may have determined that an obstruction (e.g., a pothole) exists in the zone 416 of the intersection 101 and that the object 423 approaching the intersection 101 in the zone 416 needs to avoid the obstruction and deviate to the zone 418 for crossing the intersection 101. Furthermore, the scheduled closure determined at step 518 may suggest the zone 410 is closed. Therefore, at step 520, the traffic controller 106 may update the rule determined at step 516 to inform the objects 423 approaching the intersection 101 towards zone 416 to instead use the zone 418 as they approach the intersection 101 and then either proceed to the zone 408, turn left to use the zone 422, or turn right into the zone 414 after passing the intersection 101.

In the absence of any traffic rule determined at step 516, at step 520, the traffic controller 106 simply creates a new rule. For example, the traffic controller 106 may create a rule that every object 423 approaching or cross the intersection 101 is to avoid the zone 410 and instead should use the zone 408, the zone 422 and/or the zone 414, etc.

Thereafter, at step 522, the traffic controller 106 communicates the traffic rules to incoming traffic (incoming objects 423) approaching or detected in the affected zone(s) and/or in adjacent zones.

In one example, the traffic controller 106 may send the communications to the light controller 102, which may in turn poll communication components of incoming objects (incoming connected objects, autonomous vehicles, mobile devices associated with drivers and bike riders and pedestrians, etc.) in the affected zone and/or adjacent zone(s) in order to send them appropriate traffic rules and messages as determined at step 516.

In one example and when the traffic controller 106 is located near the intersection 101 (e.g., the traffic controller 106 and the light controller 102 are the same physical unit), the traffic controller 106 can directly poll and/or otherwise communicate with the incoming objects at the intersection 101 to communicate the corresponding traffic rule(s) thereto.

Thereafter, the process may revert back to step 500 and the traffic controller 106 may repeat steps 500-522 continuously.

While FIG. 5 has been described for an example of one obstruction being detected at the intersection 101, inventive concepts are not limited thereto and that the traffic controller 106 can simultaneously detect multiple obstructions at the intersection 101 and determine and communicate traffic rules to affected vehicles according to the method of FIG. 5.

In yet another example, an obstruction at a given intersection 101 may necessitate traffic rule changes at one or more adjacent or nearby intersections. Accordingly, the traffic controller 106 can manage multiple intersections such as the intersections 114 to detect obstruction(s), determine traffic rule(s) and communicate the traffic rule(s) to objects and vehicles detected at the intersections.

Figure 6:
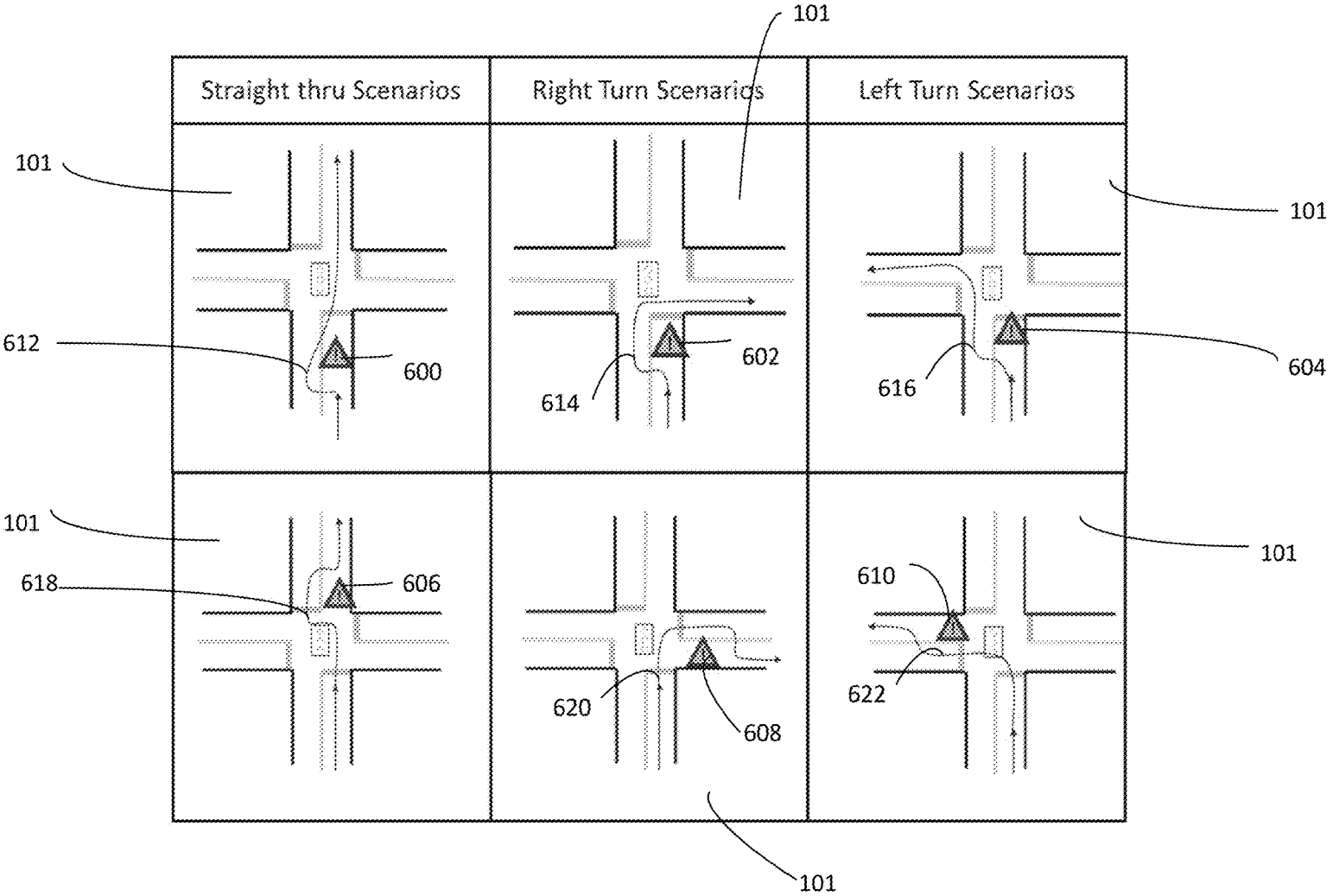
FIG. 6 shows different scenarios of obstruction detection and corresponding traffic rules at the intersection of FIG. 1.

FIG. 6 shows different scenarios of obstruction detection and corresponding traffic rules at the intersection of FIG. 1. FIG. 6 provides 6 different example scenarios of obstructions (obstructions 600 to 610) at the intersection 101 and corresponding visual representation of traffic rules 612-622, respectively, each of which indicates the change in path (the alternative path) to be taken by vehicles and objects approaching the obstruction.

In FIG. 6, the example alternative paths are grouped as straight through scenarios, right turn scenarios and left turn scenarios. As seen in FIG. 6, different locations of the obstructions relative to the objects' positions and paths lead to adoption of different paths by the objects 106.

Example embodiments of the present disclosure may be provided as a computer program product, which may include a computer-readable medium tangibly embodying thereon instructions, which may be used to program a computer (or other electronic devices) to perform a process. The computer-readable medium may include, but is not limited to, fixed (hard) drives, magnetic tape, floppy diskettes, optical disks, compact disc read-only memories (CD-ROMs), and magneto-optical disks, semiconductor memories, such as ROMs, random access memories (RAMs), programmable read-only memories (PROMs), erasable PROMs (EPROMs), electrically erasable PROMs (EEPROMs), flash memory, magnetic or optical cards, or other type of media/machine-readable medium suitable for storing electronic instructions (e.g., computer programming code, such as software or firmware). Moreover, embodiments of the present disclosure may also be downloaded as one or more computer program products, wherein the program may be transferred from a remote computer to a requesting computer by way of data signals embodied in a carrier wave or other propagation medium via a communication link (e.g., a modem or network connection).

Although a variety of examples and other information was used to explain aspects within the scope of the appended claims, no limitation of the claims should be implied based on particular features or arrangements in such examples, as one of ordinary skill would be able to use these examples to derive a wide variety of implementations. Further and although some subject matter may have been described in language specific to examples of structural features and/or method steps, it is to be understood that the subject matter defined in the appended claims is not necessarily limited to these described features or acts. For example, such functionality can be distributed differently or performed in components other than those identified herein. Rather, the described features and steps are disclosed as examples of components of systems and methods within the scope of the appended claims.

Claim language reciting "at least one of" a set indicates that one member of the set or multiple members of the set satisfy the claim. For example, claim language reciting "at least one of A and B" means A, B, or A and B.

What is claimed is:

1. A method of traffic control, comprising:

receiving, by a processor, traffic data indicative of one or more objects moving through one or more computer-defined zones of an intersection, wherein the traffic data is obtained by tracking, using an optical sensor at the intersection, movement of points of the one or more objects;

mapping, by analyzing the traffic data with the processor, an average travel path through the one or more computer-defined zones of the intersection taken by the one or more objects at the intersection;

determining, by the processor, a deviation of the average travel path from a historical average travel path, wherein the deviation is indicative of a spatial deviation of the average travel path from the history average travel path;

based on the deviation, determining by the processor, a traffic rule is to be implemented for incoming objects, wherein the traffic rule is a function of the spatial deviation of the average travel path; and communicating, by the processor, the traffic rule to the incoming objects.

2. The method of claim 1, wherein the average travel path is determined over a time interval.

3. The method of claim 1, wherein the traffic rule is to be implemented if the deviation is more than a threshold, which is indicative of a presence of an obstruction at the intersection.

4. The method of claim 1, wherein the traffic rule indicates at least one alternative travel path to be taken by the incoming objects.

5. The method of claim 4, wherein the at least one alternative travel path is a path, a use of which is restricted for the incoming objects absent the deviation.

6. The method of claim 5, further comprising:

based on the deviation, determining an additional traffic rule for additional incoming objects using the at least one alternative travel path absent the deviation, the additional traffic rule directing the additional incoming objects to follow a procedure for avoiding collision with the incoming objects that are using the at least one alternative travel path due to the deviation and according to the traffic rule.

7. The method of claim 1, further comprising:

determining if a scheduled lane closure corresponding to the intersection exists; and upon determining that the scheduled lane closure exists, updating the traffic rule based on the scheduled lane closure.

8. A traffic controller, comprising:

memory having computer-readable instructions stored therein; and one or more processors configured to execute the computer-readable instructions to:

receive traffic data indicative of one or more objects moving through one or more computer-defined zones of an intersection, wherein the traffic data is obtained by tracking, using an optical sensor at the intersection, movement of points of the one or more objects;

analyze the traffic data to map an average travel path through the one or more computer-defined zones of the intersection taken by the one or more objects at the intersection;

determine a deviation of the average travel path from a historical average travel path, wherein the deviation is indicative of a spatial deviation of the average travel path from the history average travel path;

based on the deviation, determine a traffic rule is to be implemented for incoming objects, wherein the traffic rule is a function of the spatial deviation of the average travel path; and communicate the traffic rule to the incoming objects.

9. The traffic controller of claim 8, wherein the one or more processors are configured to execute the computer-readable instructions to:

retrieve historical traffic data from a traffic database; and determine the historical average travel path based on the historical traffic data retrieved from the traffic data base.

10. The traffic controller of claim 9, wherein the average travel path is determined over a first time interval and the historical average travel path is determined over a second time interval, and the second time interval has a longer duration than the first time interval.

11. The traffic controller of claim 8, wherein the traffic rule is to be implemented if the deviation is more than a threshold, which is indicative of a presence of an obstruction at the intersection.

12. The traffic controller of claim 8, wherein:

the traffic rule indicates at least one alternative travel path to be taken by the incoming objects, and the at least one alternative travel path is a path, a use of which is restricted for the incoming objects absent the deviation.

13. The traffic controller of claim 12, wherein the one or more processors are configured to execute the computer-readable instructions to:

based on the deviation, determine an additional traffic rule for additional incoming objects using the at least one alternative travel path absent the deviation, the additional traffic rule directing the additional incoming objects to follow a procedure for avoiding collision with the incoming objects that are using the at least one alternative travel path due to the deviation and according to the traffic rule.

14. One or more non-transitory computer-readable medium having computer-readable instructions stored therein, which when executed by one or more processors, cause the one or more processors to:

receive traffic data indicative of one or more objects moving through one or more computer-defined zones of an intersection, wherein the traffic data is obtained by tracking, using an optical sensor at the intersection, movement of points of the one or more objects;

analyze the traffic data to map an average travel path through the one or more computer-defined zones of the intersection taken by the one or more objects at the intersection;

determine a deviation of the average travel path from a historical average travel path, wherein the deviation is indicative of a spatial deviation of the average travel path from the history average travel path;

based on the deviation, determine a traffic rule is to be implemented for incoming objects, wherein the traffic rule is a function of the spatial deviation of the average travel path; and communicate the traffic rule to the incoming objects.

15. The one or more non-transitory computer-readable medium of claim 14, wherein the execution of the computer-readable instructions by the one or more processors, cause the one or more processors to:

retrieve historical traffic data from a traffic database; and determine the historical average travel path based on the historical traffic data retrieved from the traffic data base.

16. The one or more non-transitory computer-readable medium of claim 15, wherein the average travel path is determined over a first time interval and the historical average travel path is determined over a second time interval, and the second time interval has a longer duration than the first time interval.

17. The one or more non-transitory computer-readable medium of claim 14, wherein the traffic rule is to be implemented if the deviation is more than a threshold, which is indicative of a presence of an obstruction.

18. The one or more non-transitory computer-readable medium of claim 14, wherein:

the traffic rule indicates at least one alternative travel path to be taken by the incoming objects, and the at least one alternative travel path is a path, a use of which is restricted for the incoming objects absent the deviation.

19. The one or more non-transitory computer-readable medium of claim 18, wherein the execution of the computer-readable instructions by the one or more processors, cause the one or more processors to:

based on the deviation, determine an additional traffic rule for additional incoming objects using the at least one alternative travel path absent the deviation, the additional traffic rule directing the additional incoming objects to follow a procedure for avoiding collision with the incoming objects that are using the at least one alternative travel path due to the deviation and according to the traffic rule.

20. The one or more non-transitory computer-readable medium of claim 14, wherein the execution of the computer-readable instructions by the one or more processors, cause the one or more processors to:

determine if a scheduled lane closure corresponding to the intersection exists; and upon determining that the scheduled lane closure exists, update the traffic rule based on the scheduled lane closure.

* * * * *